US005803148A

United States Patent [19]

Madsen

[11] Patent Number: 5,803,148

[45] Date of Patent: Sep. 8, 1998

[54] OPERATING DEVICE FOR A SCREENING ARRANGEMENT

[75] Inventor: Lars Holck Madsen, Billund, Denmark

[73] Assignee: V. Kann Rasmussen Industri A/S, Søborg, Denmark

[21] Appl. No.: 860,094

[22] PCT Filed: Mar. 6, 1996

[86] PCT No.: PCT/DK96/00094

§ 371 Date: Jul. 2, 1997

§ 102(e) Date: Jul. 2, 1997

[87] PCT Pub. No.: WO96/27728

PCT Pub. Date: Sep. 12, 1996

[30] Foreign Application Priority Data

Mar. 6, 1995 [DK] Denmark ..... 0230/95

[51] Int. Cl.[6] ..... E06B 9/36

[52] U.S. Cl. ..... 160/176.1 R; 160/321

[58] Field of Search ..... 160/168.1 R, 168.1 V, 160/176.1 R, 176.1 V, 172 R, 172 V, 107, 176.1 P, 84.04, 291, 298, 307, 321

[56] References Cited

U.S. PATENT DOCUMENTS

| | | | |
|---|---|---|---|
| 3,789,905 | 2/1974 | Saito | 160/176.1 V X |
| 4,224,973 | 9/1980 | Hugin | 160/176.1 V X |
| 4,557,159 | 12/1985 | Gross | 160/176.1 V X |
| 4,657,060 | 4/1987 | Kaucic . | |
| 4,681,279 | 7/1987 | Nakamura . | |
| 4,773,464 | 9/1988 | Kobayashi | 160/176.1 P X |
| 4,848,433 | 7/1989 | Bresson et al. . | |
| 5,137,073 | 8/1992 | Huang . | |
| 5,399,129 | 3/1995 | Ciolli . | |

FOREIGN PATENT DOCUMENTS

| | | |
|---|---|---|
| 158622 | 6/1990 | Denmark . |
| 0 086 000 | 4/1988 | European Pat. Off. . |
| 0 594 265 | 4/1994 | European Pat. Off. . |
| 0 659 974 | 6/1994 | European Pat. Off. . |
| 8900404 | 8/1990 | Sweden . |

*Primary Examiner*—David M. Purol
*Attorney, Agent, or Firm*—Lane, Aitken & McCann

[57] ABSTRACT

The operating device has an input shaft (20) which by one end is connected with a driving arrangement with a rotatable wheel (17) for receiving an endless cord (8), and which by the other end is coupled to an output shaft (14) which is connected in a rotationally locked manner with the screening arrangement. The input shaft (20) is connected with the output shaft (14) via a transmission shifting device, in particular a planet gear (21). Between the transmission shifting device and the output shaft, a mechanism is engaged for limitation of the transferred driving torque. This mechanism is constituted by a sliding clutch having a first coupling part (25) in connection with the transmission shifting device (21) and a second coupling part (26) in connection with the output shaft (14). The first coupling part (25) may have a toothed shaft (24)and the second coupling part (26) a slotted and toothed rim (27), or vice versa. Furthermore, a brake is provided for retaining the screening arrangement in an arbitrary position.

6 Claims, 2 Drawing Sheets

OPERATING DEVICE FOR A SCREENING ARRANGEMENT

BACKGROUND OF THE INVENTION

The invention concerns an operating device for a screening arrangement comprising an input shaft which by one end is connected with a driving means, in particular including a rotatable wheel for receiving an operating means such as an endless cord, and which by the other end is coupled to an output shaft connected in a rotationally locked manner with the screening arrangement via a transmission shifting device, in particular a planet gear with one or more transmission stages.

Such a device is known, among others, from U.S. Pat. Nos. 4,657,060, 5,137,037 and 4,848,433. In operating devices of this type, the transmission shifting device performs the function either—in case of manual operation as in the two first-mentioned patents—of ensuring an easy operation without using great forces, or—in case of eg. electrical operation by a motor having a relatively high velocity of rotation—of providing the accuracy aimed at when adjusting the position of the screening arrangement.

A drawback when using transmissions in this connection is, however, that the load on the parts of the screening arrangement is considerably increased if the transferred driving torque becomes too large. For instance, if the screening arrangement hits an end stop in one of its end positions, in the form of a top case or a bottom or top section of the sash or the main frame and the operation cord is still being pulled, the driving torque may at worst cause damage in parts of the screening arrangement.

SUMMARY OF THE INVENTION

Consequently, it is the purpose of the invention to provide an operating device which protects the screening arrangement against damage of its parts and, at the same time, has a relatively simple and compact structure.

To this end, the operating device according to the invention is characterized in that between the transmission shifting device and the output shaft, a sliding clutch is engaged for limitation of the transferred driving torque and comprises a first coupling part in connection with the transmission shifting device and a second coupling part in connection with the output shaft, which coupling parts are in a mutual driving torque transferring engagement when the driving torque is below a predetermined threshold value, but is brought out of engagement when the driving torque exceeds said threshold value.

By this embodiment the screening arrangement is in a structurally simple manner prevented from being damaged if eg. it hits one of its end stops.

In the sliding clutch, either the first or the second coupling part may comprise a toothed shaft and the corresponding second or first coupling part a slotted and toothed rim. During normal operation of the screening arrangement, ie. where the sliding clutch transfers the driving torque from the input shaft to the output shaft, this design provides a good transmission, at the same time as the teeth in the slotted rim and on the toothed shaft are allowed to ridge or slide over each other at the given threshold value for the driving torque.

On the outside of the rim, there is preferably provided a ring acting as a spring which partly serves the function of keeping the first and second coupling parts together, and partly permits the threshold value of the driving torque to be varied simply by varying the spring characteristic of the ring.

In an embodiment of the invention, the operating device has as a further advantage also a braking means for retaining the screening arrangement in an arbitrary position and comprising an essentially semicircular ring element positioned above the wheel of the driving means and on the outside of the cord and having a slot for passage of the in- and outgoing sections of the cord, which ring element, when operating the screening arrangement, assumes a first position where the slot allows free passage of said cord sections, but at termination of operation, is moved in the peripheral direction as a consequence of the cord load stemming from the weight of the screening arrangement to another position where the slot locks the cord. In this way, the cord may during operation of the screening arrangement pass freely through the slot and when parking the arrangement, the internal edges of the slot perform a pinch effect on the cord whereby the wheel is fixed against rotation.

BRIEF DESCRIPTION OF THE DRAWINGS

In the following the invention will be explained more in detail with reference to the drawing, in which.

DETAILED DESCRIPTION OF THE PREFERRED EMBODIMENTS

Figure 1:
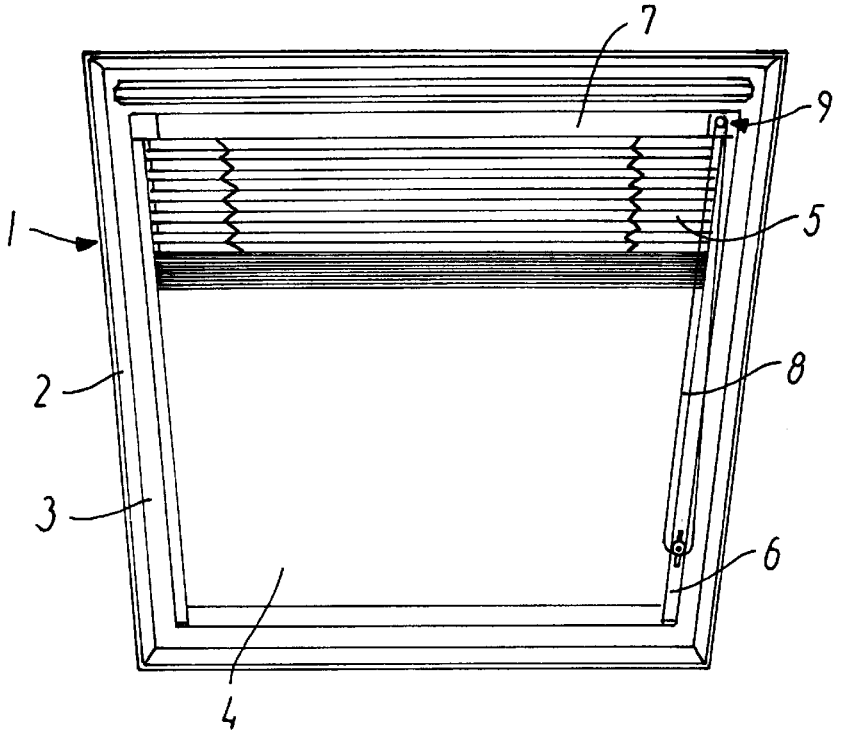
FIG. 1 shows a window with a screening arrangement and an operating device according to the invention, FIG. 2 a perspective view of the operating device, FIG. 3 a longitudinal section along the line III—III in FIG. 2, FIG. 4 a sectional view along the line IV—IV in FIG. 3, FIG. 5 a sectional view along the line V—V in FIG. 3.

In FIG. 1, a window 1 is shown with a sash 3 and a main frame 2 carrying a pane 4. On the inside of the pane 4 there is mounted a screening arrangement 5 which, in the shown design, is a Venetian blind, but of course, it may also be eg. a roller blind or a pleated blind. The Venetian blind 5 is at each end guided in guiding rails 6 along the side sections of the sash 3, and at the top of the sash 3, a top casing 7 is mounted for receiving, among other, the Venetian blind cord guidance. The operation of the Venetian blind, ie. hoisting, lowering and adjustment of the inclination of the slats is effected by means of an operating implement, such as an endless cord 8 which, as appears from the following, constitutes a part of a driving means for an operating device in general designated by 9 and positioned in the top casing 7.

Figure 2:
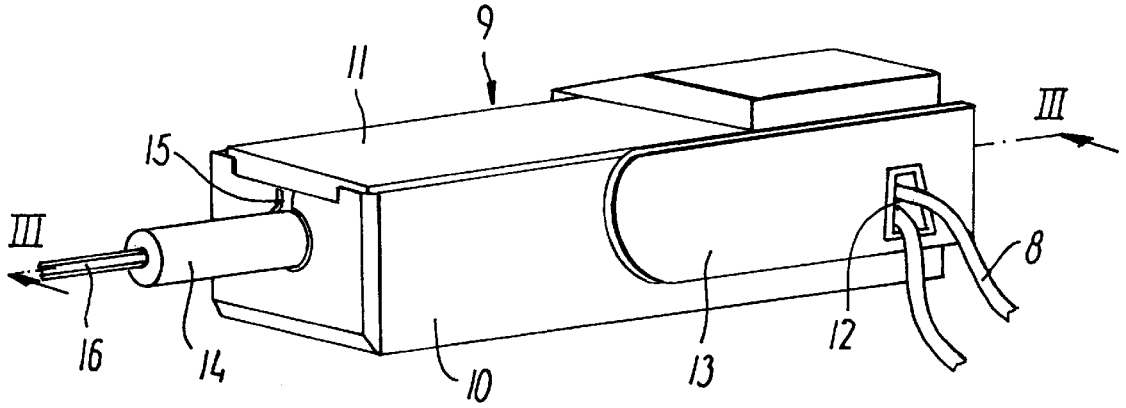

It appears from the perspective view shown in FIG. 2 how the operating device 9 comprises a housing 10 whose upper part is designed as a removable cover 11 for the mounting of the inner parts of the operating device. Furthermore, for the mounting of the operating device in the top casing 7, there are fittings (not shown in detail), and the cord 8 is guided into the interior of the housing through a hole 12 in a disc-shaped member 13 which can be demounted from the house. An output shaft 14 from the operating device is guided through a hole 15 in one of the end walls of the housing 10. The output shaft 14 is connected with the screening arrangement by an shaft 16 in a rotationally locked manner. The rotationally locked connection may eg. be provided in the way that the Venetian blind shaft 16 has a non-circular cross section, and that the output shaft 14 has a corresponding non-circular hole.

Figure 3:
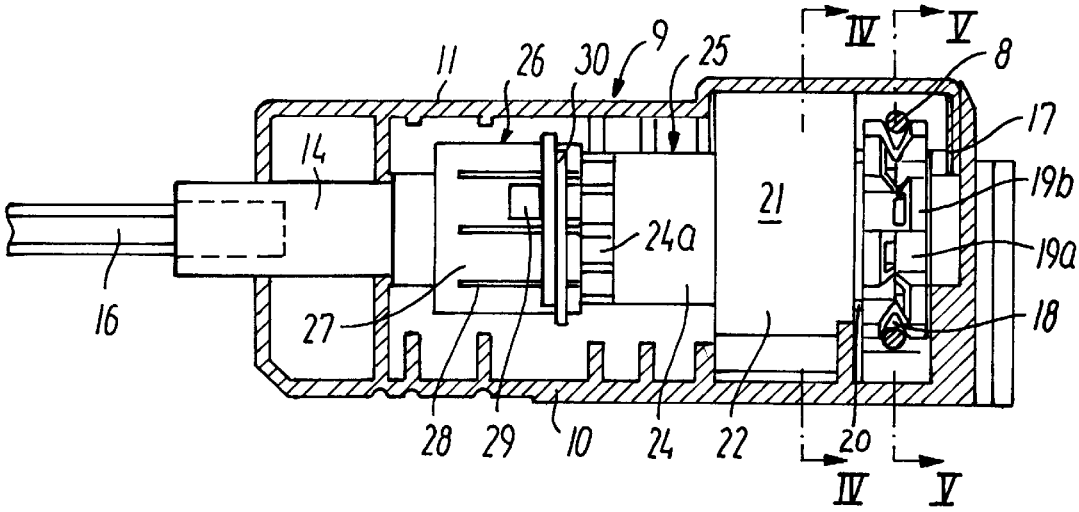
Figure 4:
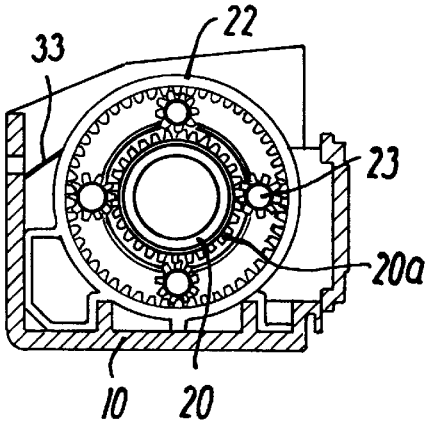
Figure 5:
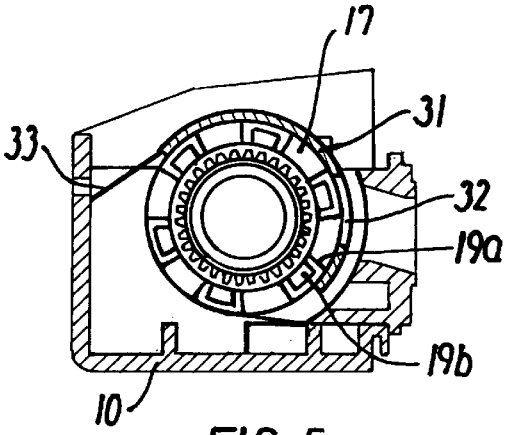

The structure of the interior of the operating device 9 appears from the sectional views in FIGS. 3–5 where, for the sake of clearness, the cord 8 is omitted in FIG. 5. To the right in FIG. 3 is shown the driving means of the operating device constituted by the operation cord 8 and a wheel 17 entwined by the cord. The wheel 17 is designed with a circumferential track 18 essentially V-shaped in cross section. With a view to providing a good engagement between the cord 8 and the wheel 17, the walls of the V-track 18 are, as it also appears from FIG. 5, provided with spaced recesses 19*a*. Thus, the walls alternate between recesses 19*a* and erected pins 19*b*, and the recesses 19*a* in one wall of the V-track 18 is situated opposite the pins 19*b* in the other wall, whereby the cord so to speak coils between the pins 19*b* and thus becomes slightly wave-formed.

An input shaft 20 designed integrally with the wheel 17 and having a toothed section 20*a* (see FIG. 4) forms the sun wheel in a planet gear 21 of which only a ring wheel 22 which is stationary in relation to the housing 10 of the operating device is shown in FIG. 3. The planet gear 21 is of a type known per se and its structure is shown in the sectional view in FIG. 4. With a view to a good load distribution, the planet gear has four planet wheels 23 supported by a planet wheel carrier, not shown, on an output shaft 24 from the planet gear.

The shaft 24 outgoing from the planet gear 21 constitutes at the same time an end of a first coupling part 25 in a sliding clutch. The shaft 24 has in its end facing away from the planet gear 21 a toothing 24*a* and is provided for engagement with a second coupling part 26 in the sliding clutch. The coupling part 26 includes a rim 27 with an internal toothing and has in the edge portion axially running slits 28. A number of projections 29, of which one is shown in the figure, are positioned along the periphery of the rim 27 and retains a ring 30. The opposite end of the second coupling part 26 in relation to the rim 27 is designed integrally with the output shaft 14 of the operating device.

During normal operation of the operating device, the cord 8 pulls the wheel 18 and thus the input shaft 20 which via the planet gear 21 and the coupling parts 25 and 26 of the sliding clutch transfers the driving torque to the output shaft 14 of the operating device. If in one of the end positions of the Venetian blind, the cord 8 is pulled in a "wrong" direction, ie. eg. in the top position further in an upwards direction, the sliding clutch prevents the driving torque from being transferred from the operating device to the output shaft. The first coupling part 25 rotates in that case in the slotted rim 27 of the other coupling part 26 without transferring torque. The sliding movement is eased in the way that the toothing 24*a* on the shaft 24 and the toothing in the rim 27 are rounded. By changing the spring characteristic for the ring 30 it is further possible to adjust the threshold value where the parts 25 and 26 of the sliding clutch slide in relation to each other.

Figure 6:
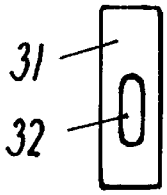
FIG. 6 shows a detail of the operating device.

In order to retain the Venetian blind in an arbitrary position, the operating device is furthermore provided with a braking means shown in more detail in FIGS. 5 and 6. The braking means is designed as an essentially semicylindrical ring element 31 with a slot 32 through which the cord 8 passes. The ring element 31 is positioned around the wheel 18 and on the outside of the cord in the V-track. A section with a semicircular form on the disc-shaped element 13 (FIG. 2) guides the ring element 31 towards the wheel 17 which on the opposite side is supported by a leaf spring 33. When using the operating device, the cord 8 pushes the internal sides of the slot 32 whereby the ring element 31 moves to a position where the cord can pass freely through the slot 32. When the operation ceases and the cord is slackened, the deadweight of the Venetian blind causes a pull in the cord, whereby the wheel 17 rotates through a small angle. Because of the friction between the internal side of the ring element 31 and the cord, the ring element 31 is by the wheel brought in this rotation to a position where the slot 32 perform a pinch effect on the cord 8, and the wheel is prevented from further rotation.

I claim:

1. An operating device for a screening arrangement, comprising:

a drive including a rotatable wheel for receiving an operating implement;

a transmission shifting device comprising a planet gear having at least one transmission stage;

an output shaft connected to the screening arrangement for rotational movement with the screening arrangement;

an input shaft having a first end connected with said drive and a second end coupled to the output shaft; and a sliding clutch engaged between the transmission shifting device and the output shaft for limiting transferred driving torque therebetween, the sliding clutch comprising a first coupling part connected with the transmission shifting device and a second coupling part connected with the output shaft, the coupling parts being in torque transferring engagement when the driving torque is below a threshold value and out of torque transferring engagement when the driving torque exceeds said threshold value.

2. An operating device according to claim 1, characterized in that the first coupling part (25) comprises a toothed shaft (24) and the second coupling part comprises a slotted and toothed rim (27).

3. An operating device according to claim 2, further comprising means for exerting a spring bias on said rim, said exerting means comprising a ring positioned on the outside of said rim.

4. An operating device according to claim 1, characterized in that the first coupling part comprises a slotted and toothed rim and the second coupling part comprises a toothed shaft.

5. An operating device according to claim 1, wherein said operating implement comprises an endless cord.

6. An operating device according to claim 5, further comprising braking means for retaining the screening arrangement in an arbitrary position, said braking means comprising an essentially semicircular ring element (31) positioned above the wheel (17) of the driving means and on the outside of the cord (8) and having a slot (32) for passage of an incoming section and an outgoing section of the cord, the ring element, when operating the screening arrangement, having a first position where the slot allows free passage of said cord sections, but at termination of operation, having a second position, moved in the peripheral direction of the wheel from the first position, where the slot (32) locks the cord.

* * * * *